US006739908B2

(12) United States Patent
Hamai et al.

(10) Patent No.: US 6,739,908 B2
(45) Date of Patent: May 25, 2004

(54) WATERPROOF CONNECTOR AND METHOD OF INSERTING TERMINALS IN WATERPROOF CONNECTOR

(75) Inventors: Tsuyoshi Hamai, Shizuoka (JP); Toshiharu Kudo, Shizuoka (JP); Masahiro Kanda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/093,396

(22) Filed: Mar. 11, 2002

(65) Prior Publication Data

US 2002/0127912 A1 Sep. 12, 2002

(30) Foreign Application Priority Data

Mar. 12, 2001 (JP) ..... P2001-069043

(51) Int. Cl.[7] ..... H01R 13/40
(52) U.S. Cl. ..... 439/587; 439/275; 439/279
(58) Field of Search ..... 439/274, 275, 439/157, 279, 587–589

(56) References Cited

U.S. PATENT DOCUMENTS 5,145,410 A * 9/1992 Maejima et al. ..... 439/587
5,197,898 A * 3/1993 Nagamine ..... 439/271
5,529,508 A * 6/1996 Chiotis et al. ..... 439/204
5,613,868 A * 3/1997 Ohsumi et al. ..... 439/275
5,618,206 A * 4/1997 Sawada et al. ..... 439/587

FOREIGN PATENT DOCUMENTS

EP 335721 * 10/1989 ..... H01R/13/523
JP 11-3854196 12/1999

* cited by examiner

*Primary Examiner*—Tho D. Ta
*Assistant Examiner*—Larisa Z Tsukerman
(74) *Attorney, Agent, or Firm*—Sughrue Mion, PLLC

(57) ABSTRACT

Housing-side intimate contact ribs are formed on a rear end surface of a male connector housing, and a holder-side intimate-contact ribs are formed on a mat seal holder which holds a mat seal on the male connector housing. These intimate-contact ribs are inserted respectively in inlet portions of intimate-contact cavity portions formed in the mat seal, thereby provisionally retaining the mat seal. In this condition, metal terminals can be easily and positively passed respectively through wire insertion holes in the mat seal.

6 Claims, 9 Drawing Sheets

WATERPROOF CONNECTOR AND METHOD OF INSERTING TERMINALS IN WATERPROOF CONNECTOR

BACKGROUND OF THE INVENTION

This invention relates to a waterproof connector, and more particularly to a waterproof connector and a method of inserting terminals in the waterproof connector, in which the efficiency of an operation for mounting the terminals in a connector housing is enhanced.

One known waterproof connector of this type is disclosed in JP-A-11-354196, and is shown in FIGS. 10A and 10B. As shown in FIG. 10A, the waterproof connector comprises a connector housing 101, a seal member 102 made of an elastic soft material, and a holder 103. The waterproof connector holds terminals 105 each connected to an end of a wire 104 therein. In this waterproof connector, when the holder 103 is locked to the connector housing 101, projections 103A (shown in FIG. 10B) on the holder 103 are press-fitted respectively into slit-shaped grooves 102A in the seal member 102 to expand the seal member 102 outwardly, so that the wires 104, press-fitted respectively in terminal/wire press-fitting holes 102B formed through the seal member 102, are compressed at their peripheries, thereby enhancing the waterproof effect.

For mounting the terminals in this waterproof connector, first, the terminals 105 and the wires 104 are inserted into respective terminal/wire insertion holes 103A in the holder 103. Then, the terminals 105 and the wires 104 are press-fitted and passed through the respective terminal/wire press-fitting holes 102B in the seal member 102 while the projections 103A of the holder 103 are not yet press-fitted in the slit-like grooves 102A in the seal member 102, respectively. Thereafter, the holder 103 is locked to the connector housing 101 through the seal member 102, and by doing so, the terminals 105 and the wires 104 can be mounted in the waterproof connector.

In the related waterproof connector shown in FIGS. 10A and 10B, however, the terminals 105 and the wires 104 are passed through the respective terminal/wire press-fitting holes 102B in the seal member 102, with the projections 103A of the holder 103 not yet press-fitted respectively in the slit-like grooves 102A in the seal member 102. Therefore, there has been encountered a problem that the terminals 105 and the wires 104 can not be easily inserted into the terminal/wire press-fitting holes 102B when the seal member 102 is twisted or deformed. Particularly, the seal member 102 is soft, and can not be kept in its predetermined shape. Therefore, there has been encountered a problem that the ability of inserting the terminals 105 and wires 104 is adversely affected by the torsion or the like of this seal member, and the terminals 105 are liable to be caught by the seal member during the insertion, and therefore are liable to be damaged. On the other hand, in case that the projections 103A of the holder 103 are beforehand inserted respectively in the slit-like grooves 102A in the seal member 102, thereby combining the seal member 102 and the holder 103 together in a unitary manner, when trying to insert the terminals 105 and the wires 104 into the respective terminal/wire press-fitting holes 102B, there is encountered a problem that the terminals 105 and the wires 104 can not be easily inserted since the terminal/wire press-fitting holes 102B are compressed into a smaller size in this condition.

SUMMARY OF THE INVENTION

It is therefore an object of this invention to provide a waterproof connector in which when inserting terminals in a mat seal (seal member), the mat seal is prevented from being twisted or deformed by the terminals.

Another object of the invention is to provide a terminal inserting method in which when inserting terminals in a mat seal, the terminals are prevented from being caught by the mat seal, thereby preventing the terminals from being damaged.

In order to solve the aforesaid object, the invention is characterized by having the following arrangement.

(1) A waterproof connector comprising:

a connector housing including a plurality of terminal receiving chambers for respectively receiving a plurality of metal terminals connected respectively to ends of wires;

a mat seal mounted at an end surface of the connector housing in which the wires are extended outwardly, and including a plurality of wire insertion holes for respectively passing the wires therethrough;

a mat seal holder, for holding the mat seal in cooperation with the connector housing, mounted at the end surface of the connector housing so that the mat seal is disposed between the connector housing and the mat seal holder;

a plurality of intimate-contact cavity portions formed in opposite sides of the mat seal and disposed in the vicinities of the plurality of wire insertion holes;

a plurality of housing-side intimate-contact ribs, for insertion respectively into the associated intimate-contact cavity portions in the mat seal, formed on the end surface of the connector housing; and a plurality of holder-side intimate-contact ribs, for insertion respectively into the associated intimate-contact cavity portions in the mat seal, formed on the mat seal holder, wherein when the plurality of metal terminals are inserted respectively into the plurality of terminal receiving chambers, the mat seal is supported by distal end portions of the plurality of housing-side intimate-contact ribs and distal end portions of the plurality of holder-side intimate-contact ribs inserted respectively in the plurality of intimate-contact cavity portions.

(2) The waterproof connector according to (1), wherein when the plurality of metal terminals are received in the plurality of terminal receiving chambers, the mat seal holder is moved toward the connector housing so that the plurality of housing-side intimate-contact ribs and the plurality of holder-side intimate-contact ribs are completely inserted respectively in the plurality of intimate-contact cavity portions so that the mat seal compresses the wires.

(3) A method of inserting terminals in a waterproof connector wherein the waterproof connector including: a connector housing including a plurality of terminal receiving chambers for respectively receiving a plurality of metal terminals connected respectively to ends of wires; a mat seal mounted at an end surface of the connector housing in which the wires are extended outwardly, and including a plurality of wire insertion holes for respectively passing the wires therethrough; and a mat seal holder, for holding the mat seal in cooperation with the connector housing, mounted at the end surface of the connector housing so that the mat seal is disposed between the connector housing and the mat seal holder; a plurality of intimate-contact cavity portions formed in opposite sides of the mat seal and disposed in the vicinities of the plurality of wire insertion holes; a plurality of housing-side intimate-contact ribs, for insertion respectively into the associated intimate-contact cavity portions in the mat seal, formed on the end surface of the connector housing; and a plurality of holder-side intimate-contact ribs, for insertion respectively into the associated intimate-contact cavity portions in the mat seal, formed on the mat seal holder, the method comprising the steps of:

inserting distal end portions of the housing-side intimate-contact ribs respectively into the associated intimate-contact cavity portions, and inserting distal end portions of the holder-side intimate-contact ribs respectively into the associated intimate-contact cavity portions, so that the mat seal is supported by the end surface of the connector housing and the mat seal holder;

passing the plurality of metal terminals and wires through the respective wire insertion holes; and completely inserting the housing-side intimate-contact ribs and the holder-side intimate-contact into the plurality of intimate-contact cavity portions, respectively, so as to hole the mat seal between the end surface of the connector housing and the mat seal holder.

According to the invention, the mat seal can be provisionally retained by the distal end portions of the housing-side intimate-contact ribs and the distal end portions of the holder-side intimate-contact ribs, without causing the torsion and deformation of the mat seal, and therefore the metal terminals and the wires can be smoothly passed through the respective wire insertion holes, and the metal terminals can be positively inserted respectively into the terminal receiving chambers in the connector housing. As a result, when inserting the terminals into the mat seal, the terminals will not be caught by the mat seal, thereby preventing the terminals from being damaged.

DETAILED DESCRIPTION OF PREFERRED EMBODIMENTS

A preferred embodiment of a waterproof connector of the present invention, as well as a method of inserting terminals in the waterproof connector, will be described in detail with reference to the drawings. Although this embodiment described below is an example in which the invention is applied to a male and a female connector of a lever fitting-type connector, the invention can be applied to various connectors other than such a lever fitting-type connector.

Waterproof Connector

Figure 1:
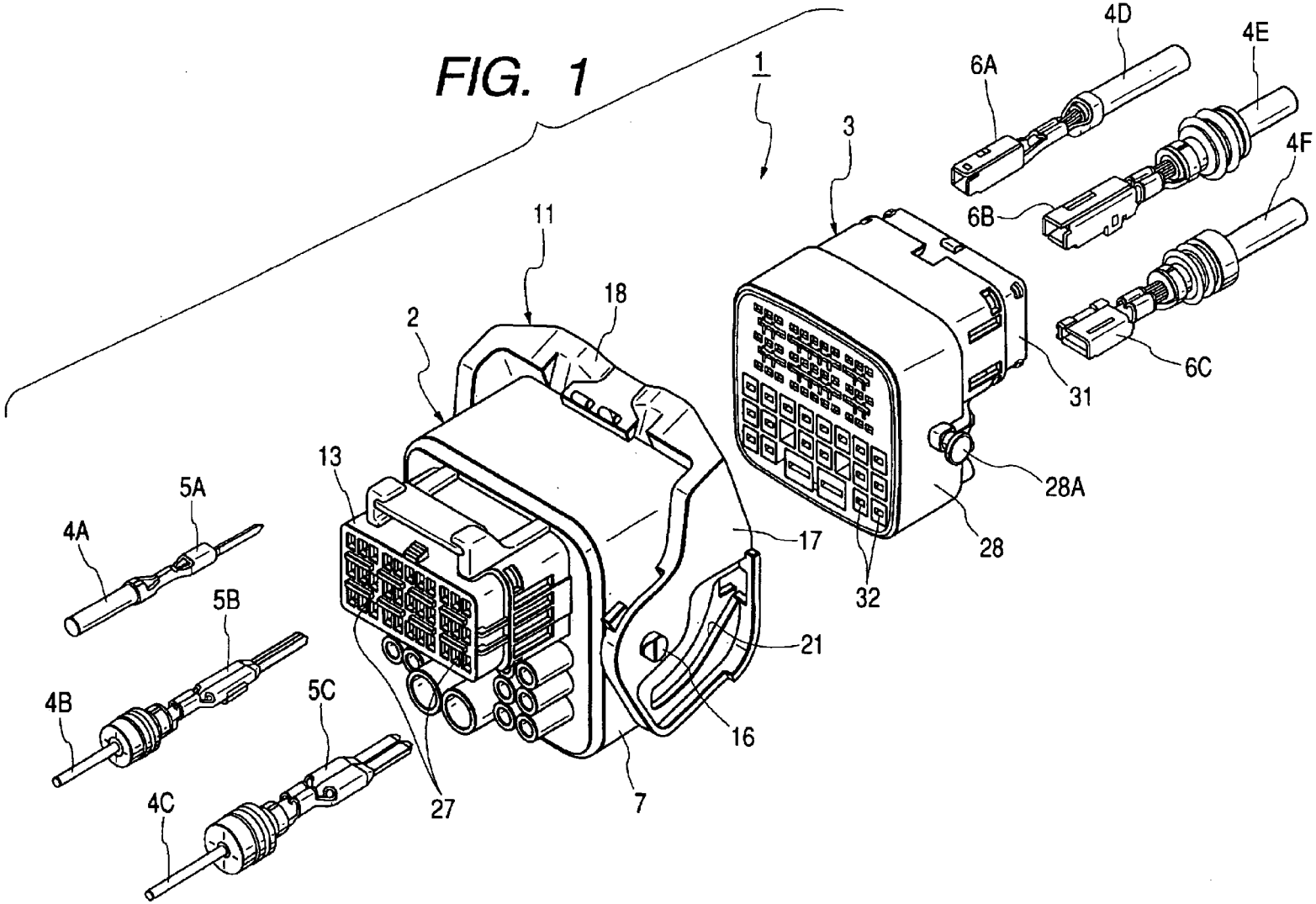
FIG. 1 is an exploded, perspective view of a preferred embodiment of a waterproof connector of the present invention.

As shown in FIG. 1, the waterproof connector 1 according to the embodiment comprises a male connector 2 and a female connector 3 which can be connected together by fitting them together. As shown in FIG. 1, various male metal terminals 5A, 5B and 5C are secured respectively to ends of a plurality of wires 4A, 4B and 4C which are to be mounted in the male connector 2. On the other hand, various female metal terminals 6A, 6B and 6C are secured respectively to ends of a plurality of wires 4D, 4E and 4F which are to be mounted in the female connector 3.

Figure 2:
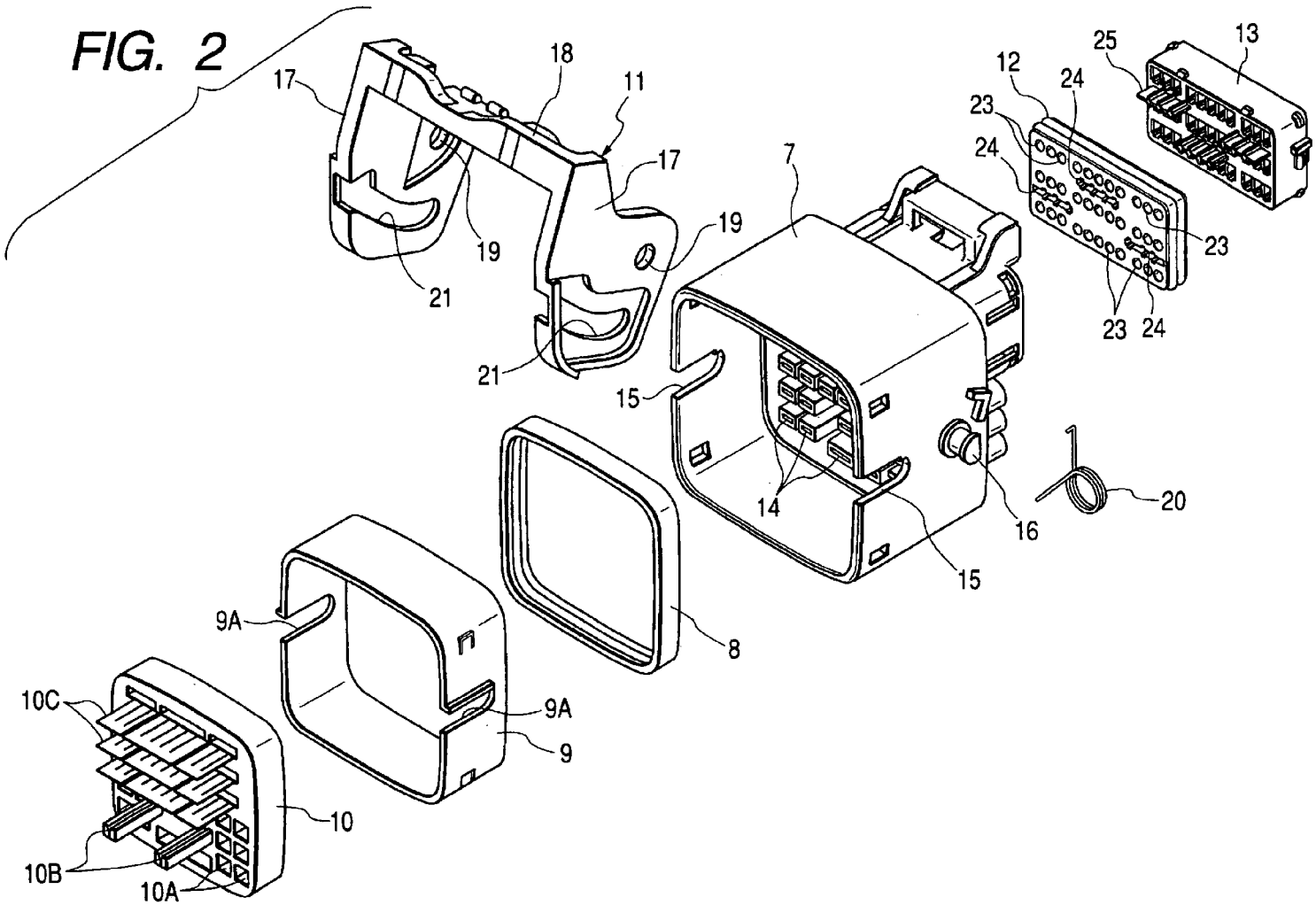
FIG. 2 is an exploded, perspective view of a male connector in the embodiment.

As shown in FIG. 2, the male connector 2 includes: a male connector housing 7; a ring-shaped packing 8 inserted in the male connector housing 7; a packing holder 9 which presses the packing 8 against the male connector housing 7 to hold this packing; a front holder 10 mounted on a front end portion of the male connector housing 7; a lever 11, pivotally supported on the male connector housing 7; a mat seal 12, which is mounted at a rear end of the male connector housing 7 and is made of a resin having elasticity; and a mat seal holder 13 which holds the mat seal 12 on the male connector housing 7.

The male connector housing 7 has a plurality of terminal receiving chambers 14 formed therethrough in a forward-rearward direction, and the male metal terminals 5A, 5B and 5C connected to the ends of the wires 4A, 4B and 4C, respectively, are received in these terminal receiving chambers. The male metal terminals 5A, 5B and 5C, when received in these terminal receiving chambers 14, are positioned at predetermined intervals in parallel relation to one another.

Guide notches 15 and 15 of a predetermined length are formed respectively in right and left portions of a front edge of the male connector housing 7, and extend rearwardly. When the female and male connectors 3 and 2 are to be connected together, guide projections 28A (described later) on the female connector 3 are inserted into these guide notches 15 and 15, respectively.

Lever rotation support shafts 16 and 16 for supporting the lever 11 are formed on and project from right and left side walls of the male connector housing 7, respectively.

Here, before describing the other portions of the male connector housing 7, the construction of the lever 11 will be described briefly. The lever 11 includes a pair of arm plates 17 and 17, which are to be disposed in contiguous relation to outer surfaces of the right and left side walls of the male connector housing 7, respectively, and an interconnecting operating portion 18 extending between these arm plates 17 and 17 to interconnect them. Shaft holes 19 for respectively fitting on the lever rotation support shafts 16 are formed through predetermined portions of the arm plates 17, respectively. The lever 11 is mounted on the male connector housing in such a manner that the shaft holes 19 and 19 are fitted on the lever rotation support shafts 16 and 16, respectively, and the lever is normally urged in a predetermined rotating direction by coil springs 20 (shown in FIG. 2) mounted respectively on the lever rotation support shafts 16 and 16.

Cam grooves 21 are formed in the arm plates 17 of the lever 11, respectively. When the lever 11 is pivotally moved against the bias of the coil springs 20, with the guide projections 28A of the female connector 2 being inserted respectively in the guide notches 15 formed in the male connector housing 7, these cam grooves 21 serve to draw the guide projections 28A respectively into inner ends of the guide notches 15.

In order that the guide projections 28A of the female connector 2 is drawn into the inner ends of the guide notches 15 in the condition in which the lever 11 is mounted on the male connector housing 7, guide notches 9A and 9A, conforming in shape to the guide notches 15, are formed in the packing holder 9.

As shown in FIG. 2, the front holder 10 is a plate of a generally rectangular plate for closing the open front end of the male connector housing 7, and a plurality of terminal receiving holes 10A are formed in those portions of this front holder corresponding respectively to the terminal receiving chambers 14 in the male connector housing 7. A plurality of gouging prevention projections 10B and female-male-reverse fitting prevention ribs 10C are formed on and project from on those portions of the front surface of the front holder 10 where the terminal receiving holes 10A are not formed.

Figure 3:
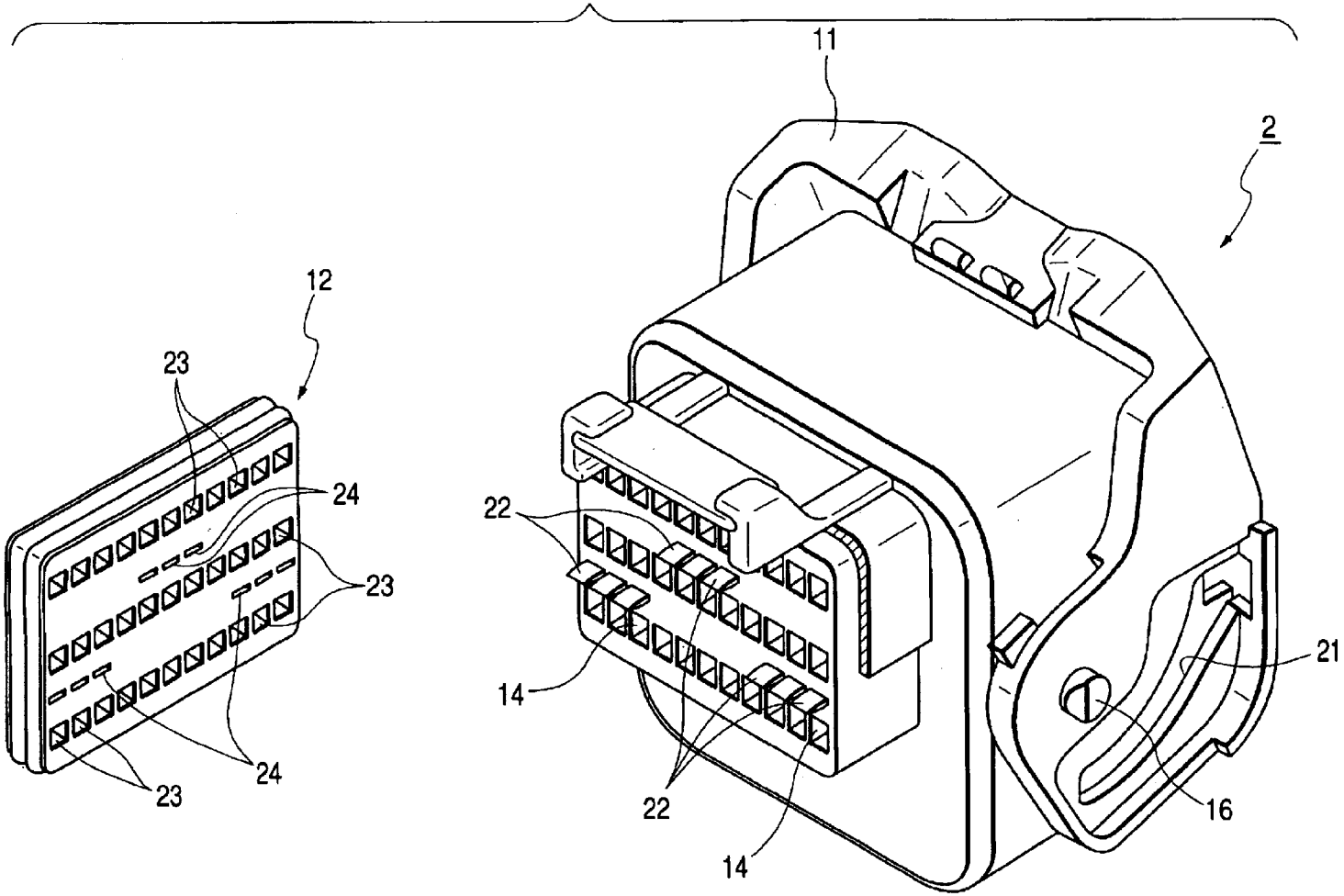
FIG. 3 is a perspective view showing a male connector housing and a mat seal in the embodiment.

As shown in FIG. 3, a plurality of housing-side intimate-contact ribs 22 for insertion respectively into intimate-contact cavity portions 24 (described later) in the mat seal 12 are formed on and project from the rear end of the male connector housing 7, that is, the rear end surface thereof from which the wires are extended outwardly.

A plurality of wire insertion holes 23 for passing the wires 4A, 4B and 4C (to which the male metal terminals 5A, 5B and 5C are secured) therethrough are formed respectively in those portions of the mat seal 12 corresponding respectively to the terminal receiving chambers 14 in the male connector housing 7. The intimate-contact cavity portions 24 for respectively receiving the housing-side intimate-contact ribs 22 (formed on the male connector housing 7) are formed in those portions of the front surface of the mat seal 12 where the wire insertion holes 23 are not formed. In this embodiment, each of the intimate-contact cavity portions 24 is formed into a slit-like shape. Similarly, intimate-contact cavity portions 26, corresponding respectively to holder-side intimate-contact ribs 25 (described late) formed on the mat seal holder 13, are formed on those portions of the rear surface of the mat seal 12 where the wire insertion holes 23 and the intimate-contact cavity portions 24 are not formed. In this embodiment, the intimate-contact cavity portions 24, formed in the front surface of the mat seal 12, and the intimate-contact cavity portions 26, formed in the rear surface of this mat seal, are arranged in offset relation, that is, in inverted relation to each other.

Figure 4:
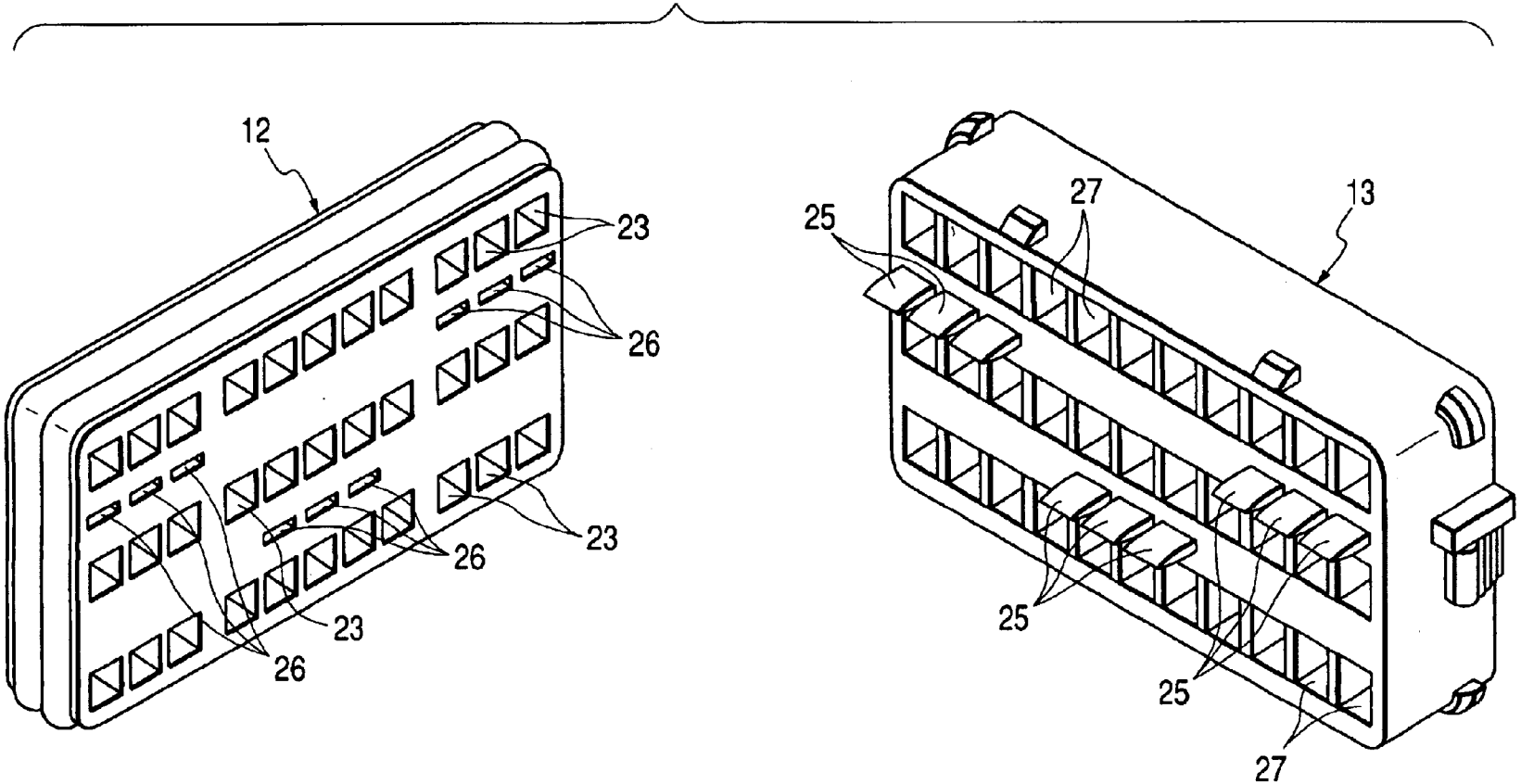
FIG. 4 is a perspective view showing the mat seal and a mat seal holder in the embodiment.

As shown in FIG. 4, wire insertion holes 27 are formed respectively in those portions of the mat seal holder 13 corresponding respectively to the wire insertion holes 23 in the mat seal 12 and also respectively to the terminal receiving chambers 14 in the male connector housing 7.

Figure 5:
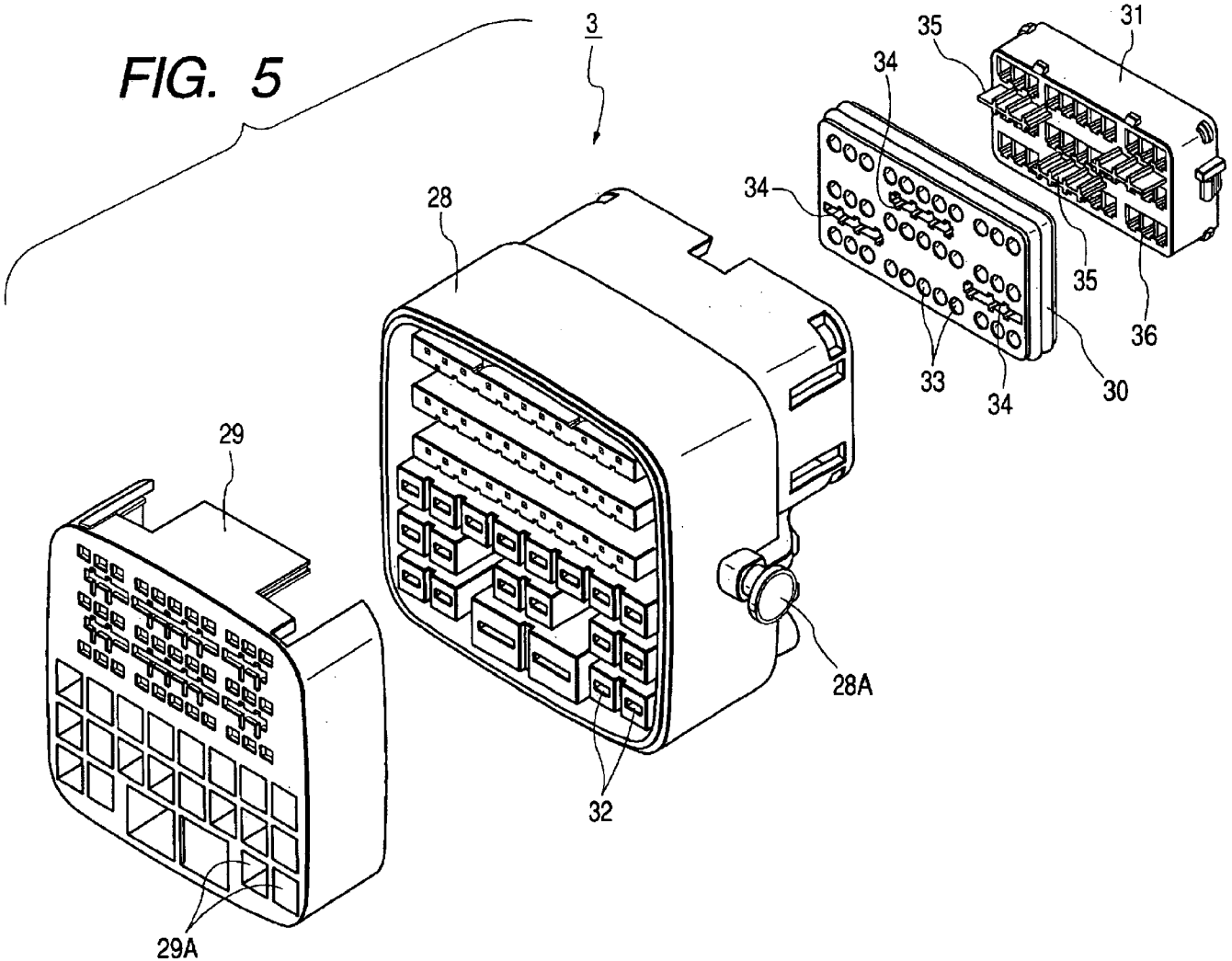
FIG. 5 is an exploded, perspective view of a female connector in the embodiment.

As shown in FIGS. 1 and 5, the female connector 3 includes: a female connector housing 28; a front holder 29 mounted on a front side of the female connector housing 28; a mat seal 30 mounted on a rear end of the female connector housing 28; and a mat seal holder 31 which holds the mat seal 30 on the female connector housing 28.

The female connector housing 28 includes a plurality of terminal receiving chambers 32 formed therethrough in a forward-rearward direction. The female metal terminals 6A, 6B and 6C connected to the ends of the wires 4D, 4E and 4F are received in these terminal receiving chambers. The female metal terminals 6A, 6B and 6C, when received in these terminal receiving chambers 32, are positioned at predetermined intervals in parallel relation to one another. The guide projections 28A for insertion into the respective guide notches 15 in the male connector 2 and for insertion into the respective cam grooves 21, formed in the lever 11, are formed on and project from right and left side walls of the female connector housing 28, respectively.

The front holder 29 is a plate-like member of a generally rectangular shape for closing an open front end of the female connector housing 28, and a plurality of terminal receiving holes 29A are formed in those portions of this front holder corresponding respectively to the terminal receiving chambers 32 in the female connector housing 28.

As shown in FIG. 5, a plurality of housing-side intimate-contact ribs (not shown) for insertion respectively into intimate-contact cavity portions 34 (described later) in the mat seal 30 are formed on and project from the rear end of the female connector housing 28, that is, the rear end surface thereof from which the wires are extended outwardly.

A plurality of wire insertion holes 33 for passing the wires 4D, 4E and 4F (to which the female metal terminals 6A, 6B and 6C are secured) therethrough are formed respectively in those portions of the mat seal 30 corresponding respectively to the terminal receiving chambers 32 in the female connector housing 28. The intimate-contact cavity portions 34 for respectively receiving the housing-side intimate-contact ribs (formed on the female connector housing 28) are formed in those portions of the front surface of the mat seal 30 where the wire insertion holes 33 are not formed. In this embodiment, each of the intimate-contact cavity portions 34 is formed into a slit-like shape. Similarly, intimate-contact cavity portions (not shown), corresponding respectively to holder-side intimate-contact ribs 35 (described late) formed on the mat seal holder 31, are formed on those portions of the rear surface of the mat seal 30 where the wire insertion holes 33 and the intimate-contact cavity portions 34 are not formed. In this embodiment, the intimate-contact cavity portions 34, formed in the front surface of the mat seal 30, and the intimate-contact cavity portions, formed in the rear surface of this mat seal, are arranged in offset relation, that is, in inverted relation to each other as described above for the mat seal 12 of the male connector 2.

As shown in FIG. 5, wire insertion holes 36 are formed respectively in those portions of the mat seal holder 31 corresponding respectively to the wire insertion holes 33 in the mat seal 30 and respectively to the terminal receiving chambers 32 in the female connector housing 28.

In this embodiment, when the male metal terminals 5A, 5B and 5C are to be inserted into the respective terminal receiving chambers 14, the mat seal 12 is supported by the distal end portions of the housing-side intimate-contact ribs 22, inserted respectively in the intimate-contact cavity portions 24 in the mat seal 12, and the distal end portions of the holder-side intimate-contact ribs 25 inserted respectively in the intimate-contact cavity portions 26 in the mat seal 12, so that the torsion and deformation of the mat seal 12 can be prevented. Therefore, the male metal terminals 5A, 5B and 5C can be positively and easily mounted and held in the male connector housing 7. The female metal terminals 6A, 6B and 6C can be mounted and held in the female connector 3 in the same manner.

Method of Inserting Terminals in Waterproof Connector

Figure 6:
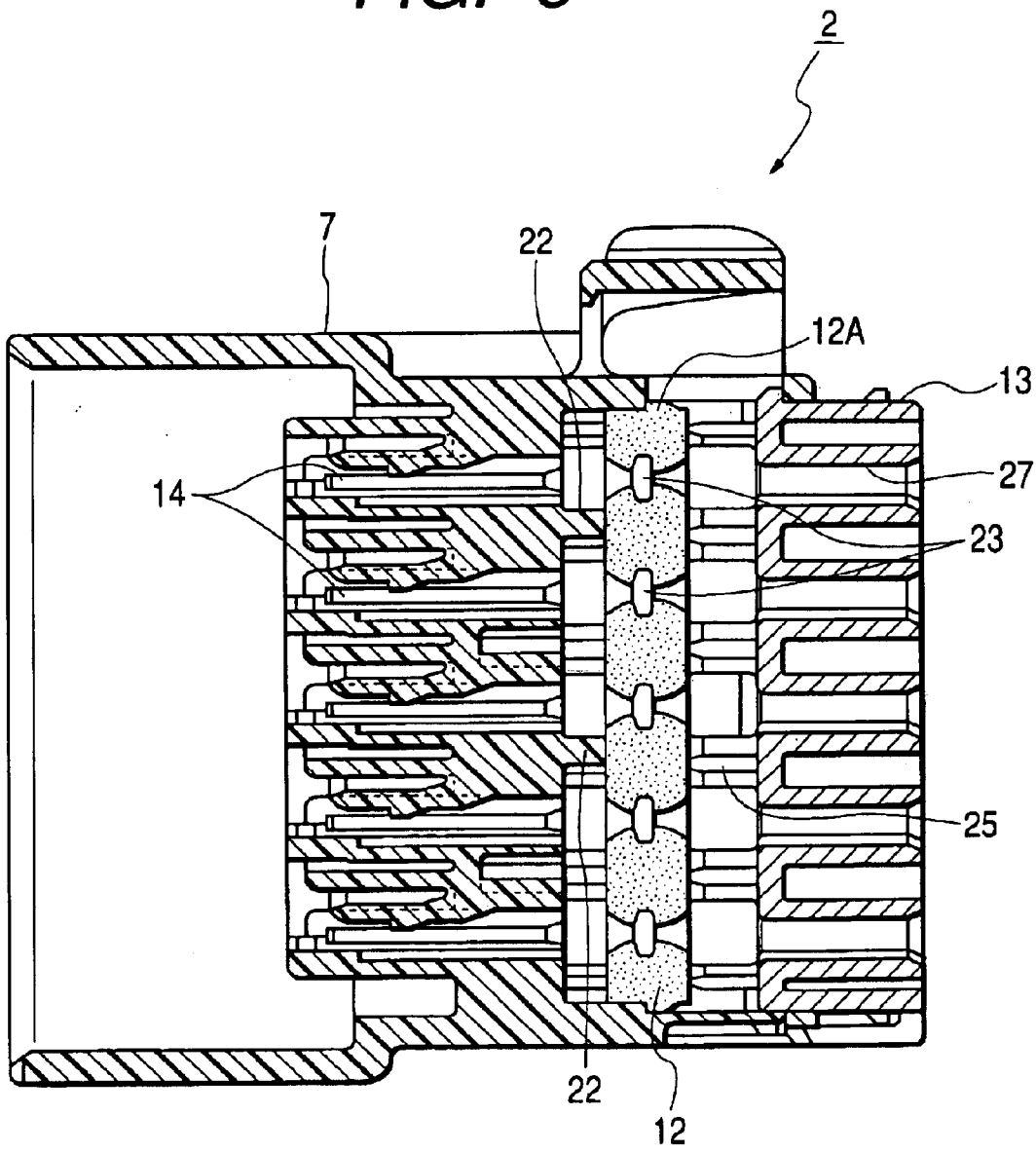
FIG. 6 is a cross-sectional view showing the process of mounting metal terminals and wires in the male connector in the embodiment.
Figure 7:
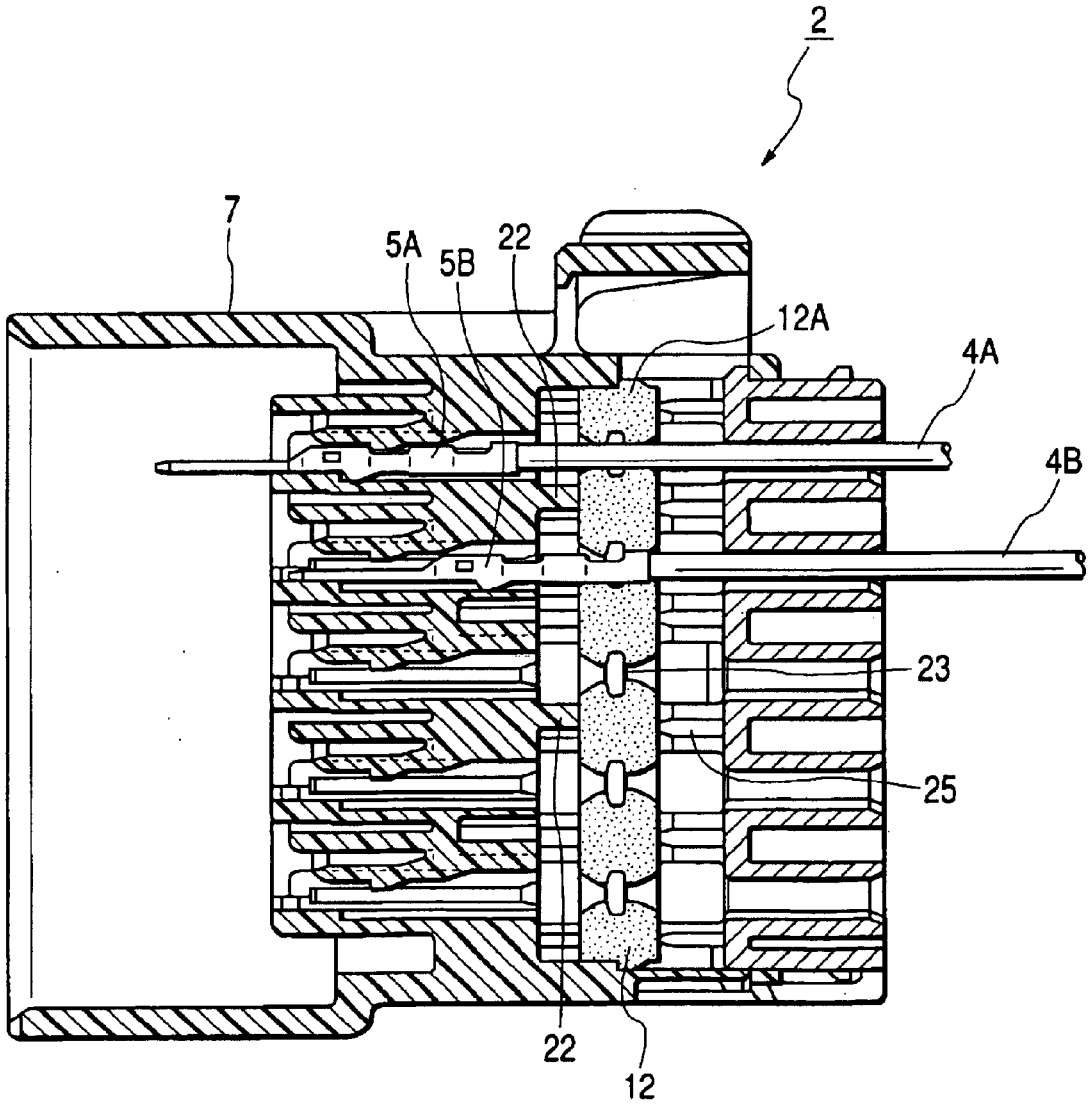
FIG. 7 is a cross-sectional view showing the process of mounting the metal terminals and the wires in the male connector in the embodiment.
Figure 8:
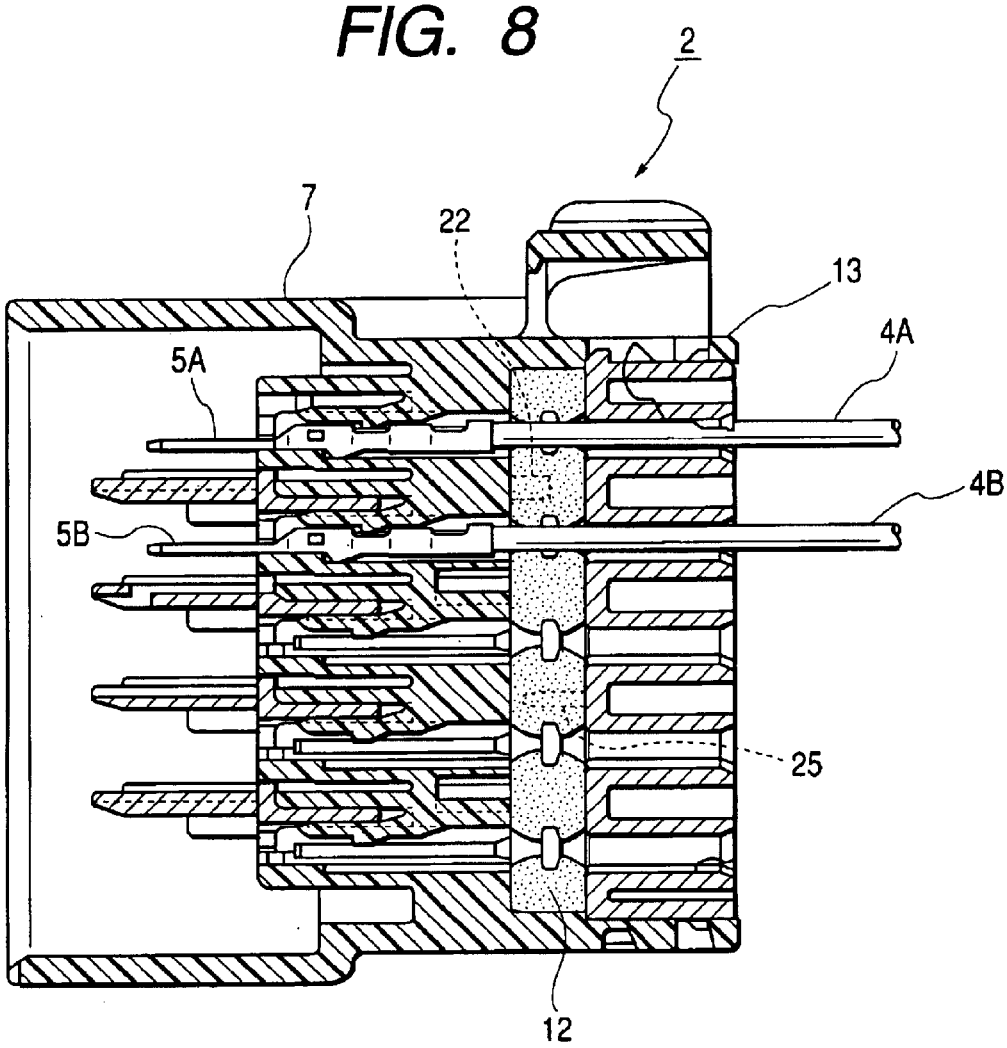
FIG. 8 is a cross-sectional view showing the process of mounting the metal terminals and the wires in the male connector in the embodiment.

Next, a method of inserting the terminals in the waterproof connector will be described with reference to FIGS. 6 to 8. FIGS. 6 to 8 show the method of inserting the male metal terminals in the male connector 2, and the same inserting method can be used for the female connector 3. Therefore, description of the terminal-inserting method for the female connector 3 will be omitted.

First, the mat seal 12 is located at the rear end portion of the male connector housing 7 as shown in FIG. 6. At this time, an outer peripheral seal portion 12A, formed on the outer peripheral surface of the mat seal 12 in a slightly outwardly-bulging manner, is abutted against the rear end portion of the male connector housing 7. The housing-side intimate-contact ribs 22, formed on the male connector housing 7, are slightly inserted respectively in inlet portions of the intimate-contact cavity portions 24 formed in the front surface of the mat seal 12, so that the wire insertion holes 23 in the mat seal 12 are not compressed, and therefore are not narrowed. The mat seal holder 13 is set at the rear side of this mat seal 12. At this time, the holder-side intimate-contact ribs 25 on the mat seal holder 13 are slightly inserted respectively in inlet portions of the intimate-contact cavity portions 26 formed in the rear surface of the mat seal 12, so that the wire insertion holes 23 in the mat seal 12 are not compressed, and therefore are not narrowed.

In this condition, the male metal terminals 5A and 5B are inserted from the rear side of the mat seal holder 13 as shown in FIG. 7. At this time, the mat seal 12 is positioned and held by the housing-side intimate-contact ribs 22 and the holder-side intimate-contact ribs 25, and therefore the male metal terminals 5A and 5B, inserted through the respective wire insertion holes 27 in the mat seal holder 13, are positively guided into the respective wire insertion holes 23 in the mat seal 12, and the male metal terminals 6A and 6B, thus passed through the respective wire insertion holes 23, are guided into the respective terminal receiving chambers 14 in the male connector housing 7.

After the male terminals 5A and 5B and so on are all inserted, the mat seal holder 13 is pushed toward the male connector housing 7 as shown in FIG. 8, so that the housing-side intimate-contact ribs 22 are press-fitted respectively into the intimate-contact cavity portions 24 in the mat seal 12 while the holder-side intimate-contact ribs 25 are press-fitted respectively into the intimate-contact cavity portions 26 in the mat seal 12. As a result, the wire insertion holes 23 compress the wires 4A and 4B and so on, thereby enhancing the waterproof effect. When the mat seal holder 13 is pushed toward the male connector housing 7, the outer peripheral seal portion 12A, formed on the outer peripheral surface of the mat seal 12, is pushed into a tubular portion formed at the rear end portion of the male connector housing 7. As a result, the waterproof sealing effect between the male connector housing 7 and the mat seal 12 is enhanced.

Although the preferred embodiment has been described above, the present invention is not limited to it, and various modifications, related to the features of the construction, can be made. For example, in the above embodiment, although the wire inserting method for the male connector 2 has been described, the wire inserting method for the female connector can be effected in the same manner.

Although the above embodiment is an example in which the invention is applied to the male and female connectors of the lever fitting-type connector, the invention can be applied to various connectors other than such a lever fitting-type connector.

Figure 9:
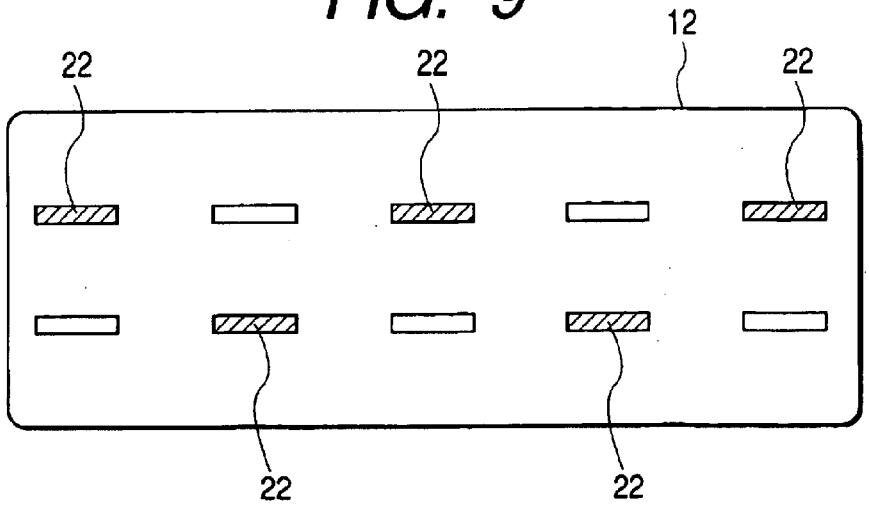
FIG. 9 is a front-elevational view explanatory of a modified form of the embodiment.
Figure 10A:
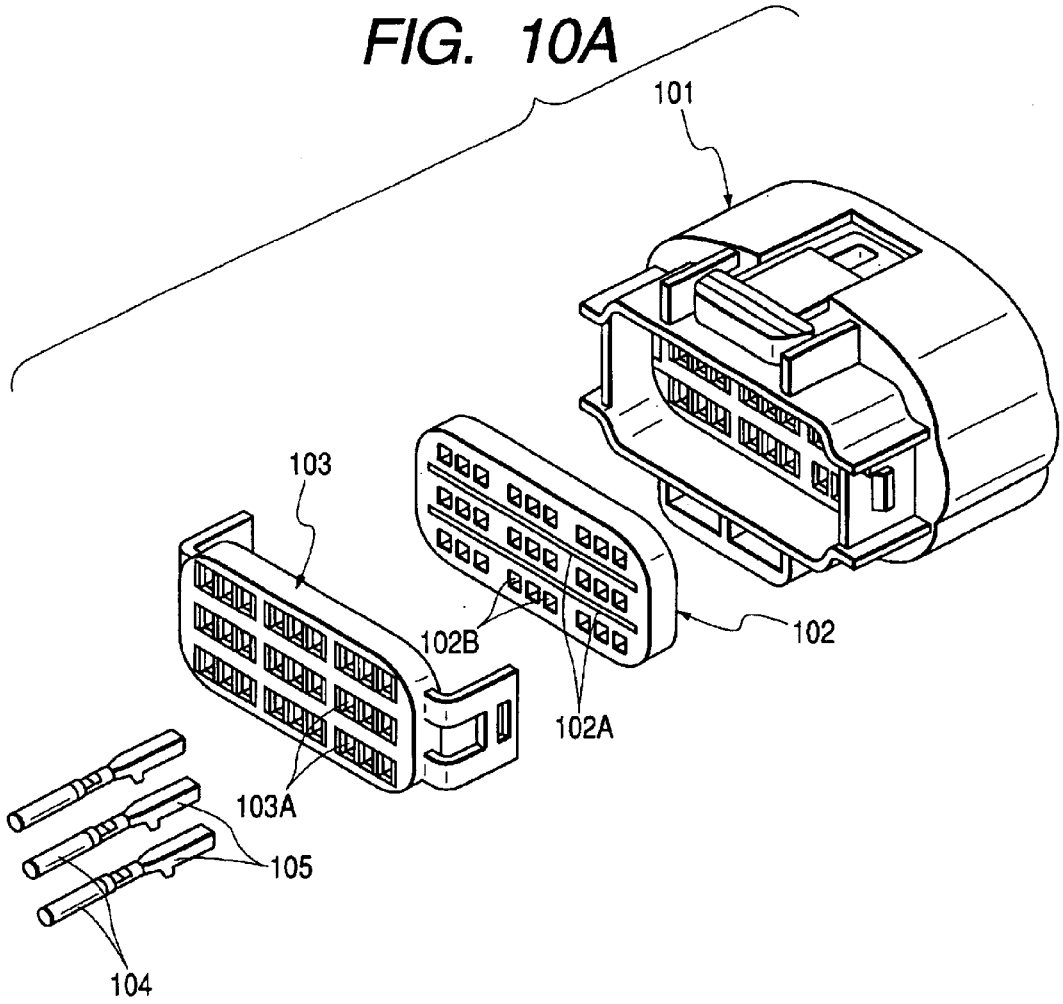
FIG. 10A is an exploded, perspective view of a related waterproof connectors
Figure 10B:
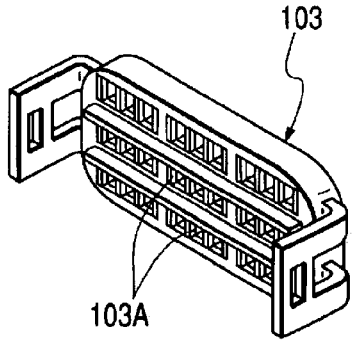
FIG. 10B is a perspective view showing a holder.

In the above embodiment, the housing-side intimate-contact ribs or the holder-side intimate-contact ribs for insertion in the intimate-contact cavity portions 26, 34 in the mat seal 12, 30 are arranged in groups each consisting of three ribs. However, for example, housing-side intimate contact ribs 22 for the mat seal 12 may be arranged in a staggered manner as shown in FIG. 9. In this case, holder-side intimate-contact ribs 25 are so arranged as to be inserted in those of intimate-contact cavity portions in which the housing-side intimate-contact ribs 22 are not inserted.

As is clear from the foregoing description, in the present invention, the mat seal can be provisionally retained by the distal end portions of the housing-side intimate-contact ribs and the distal end portions of the holder-side intimate-contact ribs, without causing the torsion and deformation of the mat seal, and therefore the metal terminals and the wires can be smoothly passed through the respective wire insertion holes, and the metal terminals can be positively inserted respectively into the terminal receiving chambers in the connector housing. Therefore, there is achieved an advantageous effect that the operation for mounting the metal terminals and the wires in the connector housing can be carried out easily and positively.

Further in the present invention, the mat seal can be provisionally retained by the distal end portions of the housing-side intimate-contact ribs and the distal end portions of the holder-side intimate-contact ribs, without causing the torsion and deformation of the mat seal, and therefore the metal terminals and the wires can be smoothly passed through the respective wire insertion holes, and the metal terminals can be positively inserted respectively into the terminal receiving chambers in the connector housing. As a result, when inserting the terminals into the mat seal, the terminals will not be caught by the mat seal, thereby preventing the terminals from being damaged.

What is claimed is:

1. A waterproof connector comprising:

a connector housing including a plurality of terminal receiving chambers for respectively receiving a plurality of metal terminals connected respectively to ends of wires;

a mat seal mounted at an end surface of the connector housing in which the wires are extended outwardly, and including a plurality of wire insertion holes for respectively passing the wires therethrough;

a mat seal holder, for holding the mat seal in cooperation with the connector housing, mounted at the end surface of the connector housing so that the mat seal is disposed between the connector housing and the mat seal holder;

a plurality of intimate-contact cavity portions formed in opposite sides of the mat seal and disposed in between the plurality of wire insertion holes;

a plurality of housing-side intimate-contact ribs, for insertion respectively into the associated intimate-contact cavity portions in the mat seal, formed on the end surface of the connector housing; and a plurality of holder-side intimate-contact ribs, for insertion respectively into the associated intimate-contact cavity portions in the mat seal, formed on the mat seal holder, wherein when the plurality of metal terminals are inserted respectively into the plurality of terminal receiving chambers, the mat seal is supported by distal end portions of the plurality of housing-side intimate-contact ribs and distal end portions of the plurality of holder-side intimate-contact ribs inserted respectively in the plurality of intimate-contact cavity portions, wherein the plurality of intimate-contact cavity portions disposed on a housing side of the mat seal are configured in inverse relation to the plurality of intimate-contact cavity portions disposed on a mat seal holder side of the mat seal.

2. The waterproof connector according to claim 1, wherein when the plurality of metal terminals are received in the plurality of terminal receiving chambers, the mat seal holder is moved toward the connector housing so that the plurality of housing-side intimate-contact ribs and the plurality of holder-side intimate-contact ribs are completely inserted respectively in the plurality of intimate-contact cavity portions so that the mat seal compresses the wires.

3. A method of inserting terminals in a waterproof connector wherein the waterproof connector including: a connector housing including a plurality of terminal receiving chambers for respectively receiving a plurality of metal terminals connected respectively to ends of wires; a mat seal mounted at an end surface of the connector housing in which the wires are extended outwardly, and including a plurality of wire insertion holes for respectively passing the wires therethrough; and a mat seal holder, for holding the mat seal in cooperation with the connector housing, mounted at the end surface of the connector housing so that the mat seal is disposed between the connector housing and the mat seal holder; a plurality of intimate-contact cavity portions formed in opposite sides of the mat seal and disposed in between the plurality of wire insertion holes; a plurality of housing-side intimate-contact ribs, for insertion respectively into the associated intimate-contact cavity portions in the mat seal, formed on the end surface of the connector housing; and a plurality of holder-side intimate-contact ribs, for insertion respectively into the associated intimate-contact cavity portions in the mat seal, formed on the mat seal holder, the method comprising the steps of:

inserting distal end portions of the housing-side intimate-contact ribs respectively into the associated intimate-contact cavity portions, and inserting distal end portions of the holder-side intimate-contact ribs respectively into the associated intimate-contact cavity portions, so that the mat seal is supported by the end surface of the connector housing and the mat seal holder;

passing the plurality of metal terminals and wires through the respective wire insertion holes; and completely inserting the housing-side intimate-contact ribs and the holder-side intimate-contact ribs into the plurality of intimate-contact cavity portions, respectively, so as to hold the mat seal between the end surface of the connector housing and the mat seal holder, wherein the plurality of intimate-contact cavity portions disposed on a housing side of the mat seal are configured in inverse relation to the plurality of intimate-contact cavity portions disposed on a mat seal holder side of the mat seal.

4. A waterproof connector comprising:

a connector housing including a plurality of terminal receiving chambers for respectively receiving a plurality of metal terminals connected respectively to ends of wires;

a mat seal mounted at an end surface of the connector housing in which the wires are extended outwardly, and including a plurality of wire insertion holes for respectively passing the wires therethrough;

a mat seal holder, for holding the mat seal in cooperation with the connector housing, mounted at the end surface of the connector housing so that the mat seal is disposed between the connector housing and the mat seal holder;

a plurality of intimate-contact cavity portions formed in opposite sides of the mat seal and disposed in between the plurality of wire insertion holes;

a plurality of housing-side intimate-contact ribs, for insertion respectively into the associated intimate-contact cavity portions in the mat seal, formed on the end surface of the connector housing; and a plurality of holder-side intimate-contact ribs, for insertion respectively into the associated intimate-contact cavity portions in the mat seal, formed on the mat seal holder, wherein when the plurality of metal terminals are inserted respectively into the plurality of terminal receiving chambers, the mat seal is supported by distal end portions of the plurality of housing-side intimate-contact ribs and distal end portions of the plurality of holder-side intimate-contact ribs inserted respectively in the plurality of intimate-contact cavity portions, wherein the plurality of intimate-contact portions are slit-shaped.

5. A waterproof connector comprising:

a connector housing including a plurality of terminal receiving chambers for respectively receiving a plurality of metal terminals connected respectively to ends of wires;

a mat seal mounted at an end surface of the connector housing in which the wires are extended outwardly, and including a plurality of wire insertion holes for respectively passing the wires therethrough;

a mat seal holder, for holding the mat seal in cooperation with the connector housing, mounted at the end surface of the connector housing so that the mat seal is disposed between the connector housing and the mat seal holder;

a plurality of intimate-contact cavity portions formed in opposite sides of the mat seal and disposed in between the plurality of wire insertion holes;

a plurality of housing-side intimate-contact ribs, for insertion respectively into the associated intimate-contact cavity portions in the mat seal, formed on the end surface of the connector housing; and a plurality of holder-side intimate-contact ribs, for insertion respectively into the associated intimate-contact cavity portions in the mat seal, formed on the mat seal holder, wherein when the plurality of metal terminals are inserted respectively into the plurality of terminal receiving chambers, the mat seal is supported by distal end portions of the plurality of housing-side intimate-contact ribs and distal end portions of the plurality of holder-side intimate-contact ribs inserted respectively in the plurality of intimate-contact cavity portions, wherein the plurality of housing-side intimate contact ribs are arranged in a staggered manner.

6. A waterproof connector comprising:

a connector housing including a plurality of terminal receiving chambers for respectively receiving a plurality of metal terminals connected respectively to ends of wires;

a mat seal mounted at an end surface of the connector housing in which the wires are extended outwardly, and including a plurality of wire insertion holes for respectively passing the wires therethrough;

a mat seal holder, for holding the mat seal in cooperation with the connector housing, mounted at the end surface of the connector housing so that the mat seal is disposed between the connector housing and the mat seal holder;

a plurality of intimate-contact cavity portions formed in opposite sides of the mat seal and disposed in between the plurality of wire insertion holes;

a plurality of housing-side intimate-contact ribs, for insertion respectively into the associated intimate-contact cavity portions in the mat seal, formed on the end surface of the connector housing; and a plurality of holder-side intimate-contact ribs, for insertion respectively into the associated intimate-contact cavity portions in the mat seal, formed on the mat seal holder, wherein when the plurality of metal terminals are inserted respectively into the plurality of terminal receiving chambers, the mat seal is supported by distal end portions of the plurality of housing-side intimate-contact ribs and distal end portions of the plurality of holder-side intimate-contact ribs inserted respectively in the plurality of intimate-contact cavity portions, wherein the plurality of housing-side intimate contact ribs are arranged in groups consisting of three ribs.

* * * * *